US006230886B1

(12) United States Patent
Bradshaw

(10) Patent No.: US 6,230,886 B1
(45) Date of Patent: May 15, 2001

(54) GOLF CLUB HEAD COVER

(75) Inventor: Bruce Bradshaw, Clarion, IA (US)

(73) Assignee: Team Effort, Inc., Clarion, IA (US)

( * ) Notice: Subject to any disclaimer, the term of this patent is extended or adjusted under 35 U.S.C. 154(b) by 0 days.

(21) Appl. No.: 09/364,560

(22) Filed: Jul. 30, 1999

(51) Int. Cl.[7] ..... A63B 57/00

(52) U.S. Cl. ..... 206/315.2; 206/315.4; 150/160

(58) Field of Search ..... 150/160, 159; 206/315.2, 315.4

(56) References Cited

U.S. PATENT DOCUMENTS

| | | | | |
|---|---|---|---|---|
| 2,526,985 | * | 10/1950 | Whitehead | 150/160 |
| 2,532,195 | * | 11/1950 | Rosenow et al. | 150/160 |
| 3,023,795 | * | 3/1962 | Denkert | 150/160 |
| 3,303,865 | * | 2/1967 | Ouimet | 150/168 |
| 3,727,659 | * | 4/1973 | Shuford | 150/160 |
| 5,284,194 | | 2/1994 | Gaffney | 150/160 |
| 5,738,157 | | 4/1998 | Gaffney | 150/160 |

FOREIGN PATENT DOCUMENTS

| | | | | |
|---|---|---|---|---|
| 1360058 | * | 7/1974 | (GB) | 206/315.2 |

* cited by examiner

*Primary Examiner*—Sue A. Weaver
(74) *Attorney, Agent, or Firm*—Zarley, McKee, Thomte, Voorhees & Sease

(57) ABSTRACT

A golf club head cover that fits a variety of different sized club heads. The golf club head cover has a hollow head cover portion with an upper end and a lower end, the upper end closed and the lower end open, an elongated shaft protector extending downwardly from the lower end of the head cover portion, and a knit sock disposed inside the head cover portion. The knit sock inside the head cover portion functions to provide a tight fit around the club head and secure the golf club head cover in place. The present invention also includes a method of protecting golf club heads of various sizes through use of a golf club head cover having a knit sock disposed within the head cover.

13 Claims, 2 Drawing Sheets

GOLF CLUB HEAD COVER

BACKGROUND OF THE INVENTION

1. Field of the Invention

The present invention relates to golf accessories. More particularly, though not exclusively, the present invention relates to an improved golf club head cover.

2. Problems in the Art

Golf club head covers have been used for many years to protect the heads of golf clubs from marring and scratching when they are carried in a golf bag. These head covers are typically made of a soft, padded, bulky material and extend around the head and a relatively short distance over the end of the shaft where it attaches to the head. These head covers are closed at the upper end and are open at the lower end, from which the shaft extends. The opening is relatively wide, allowing easy placement of the cover on the club head and removal of the cover from the club head when that particular club is selected for use.

The advent of graphite golf shafts created a need to also protect a portion of the shaft, which extends outwardly from the top of the golf bag, against contact with the heads of uncovered clubs or from contact with the shafts of adjacent clubs. Additional wear also results from the golf bag dividers rubbing against the shafts. Graphite shafts are more prone to scratching and nicking than steel shafts. One way to protect the exposed portion of graphite shafts is to sew a "knit sock" into the opening at the lower end of the head cover. The sock extends downwardly from the head cover opening and terminates in a slightly enlarged end for the ingress and egress of the golf club head and shaft. This "sock" is essentially an elongated open-ended tube, the top end of which is secured all around the lower end of the head cover. The sock generally has a relatively small internal diameter in its relaxed position. This effectively is produced by means of the elongated ribs of the type employed in socks for personal wear.

While such golf club head covers provide the desired protection, a significant disadvantage exists. Golf club head covers are typically designed "one size fits all." That is, the same size of head cover is used with a driver and a fairway wood. In recent years, oversized woods have gained great popularity. A problem exists in designing a head cover that fits oversized woods as well as fairway woods and shallow-faced woods. When used with smaller sized woods, the head cover fits loosely on the golf club head and can slide over or fall off of the club head. Thus, there is a need in the art for an improved golf club head cover that properly fits club heads of various sizes.

FEATURES OF THE INVENTION

A general feature of the present invention is the provision of an improved golf club head cover that overcomes the problems found in the prior art.

A further feature of the present invention is the provision of a golf club head cover that fits golf club heads of various sizes.

A further feature of the present invention is the provision of a method for protecting golf club heads of various sizes.

A still further feature of the present invention is the provision of a golf club head cover that is durable in use and economical to manufacture.

These as well as other features and advantages of the present invention will become apparent from the following specification and claims.

SUMMARY OF THE INVENTION

The golf club head cover of the present invention includes a hollow head cover portion, an elongated shaft protector that extends downwardly from the lower end of the head cover portion, and a knit sock disposed within the head cover portion. In its preferred form, the elongated shaft protector and the knit sock are integrally formed. The golf club head cover also preferably includes an elastic section on the knit sock intermediate the upper and lower ends of the head cover section. The knit sock inside the head cover portion is flexible and forms around the club head and provides a relatively tight fit.

The present invention also includes a method of protecting golf club heads of various sizes. The method generally includes the steps of providing a head cover as described above, and inserting the golf club head through the bottom end of shaft protector and into the head cover portion so that the knit sock forms around the golf club head. In a preferred method, an elastic section is sewn in the knit sock between the upper and lower ends of the head cover portion, and the golf club head is inserted past the elastic section.

DETAILED DESCRIPTION OF THE PREFERRED EMBODIMENT

The present invention will be described as it applies to its preferred embodiment. It is not intended that the present invention as claimed be limited to the described embodiment. It is intended that the invention cover all modifications and alternatives which may be included within the spirit and scope of the invention.

Figure 1:
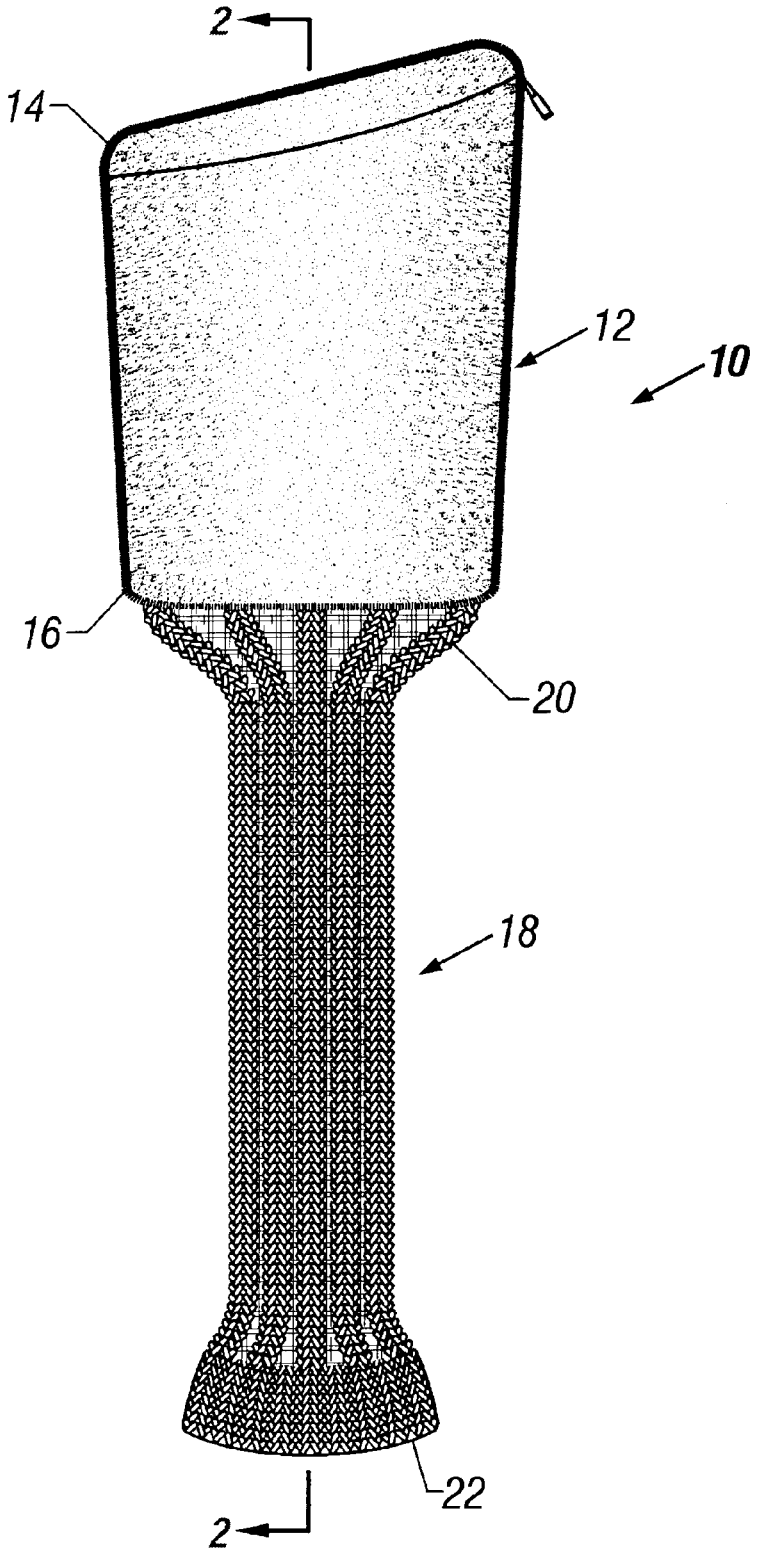
FIG. 1 is a side elevational view of the golf club head cover of the present invention.

Now referring to the drawings, FIG. 1 shows the golf club head cover of the present invention designated by the reference number 10. The golf club head cover 10 includes an enlarged head cover portion 12, which is in the form of a generally hollow cylindrical member with a closed upper end 14 and an open bottom end 16. The golf club head cover 10 also includes an elongated shaft protector 18. The shaft protector 18 is an elongated open-ended cylindrical knit sock-like member that has a top end 20 and a bottom end 22. The top end 20 of the shaft protector 18 extends from the lower end 16 of the head cover portion 12. The bottom end 22 of the shaft protector 18 has a generally outwardly flared end on it. This end has an opening which is somewhat greater than the relaxed internal cross-sectional opening of the main portion of the shaft protector 18.

Figure 2:
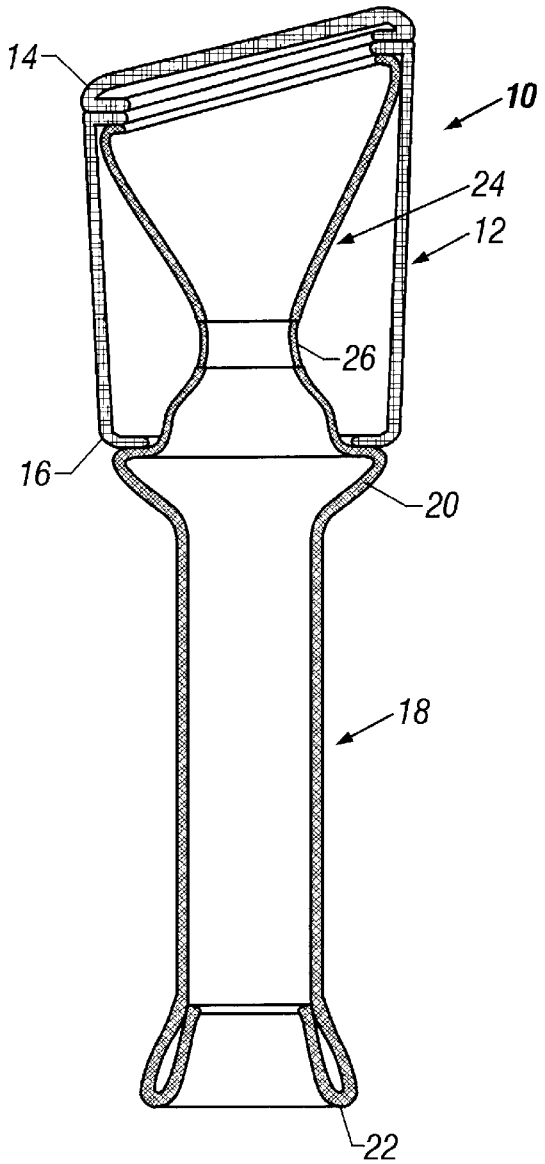
FIG. 2 is a sectional view taken along line 2—2 of FIG. 1.
Figure 3:
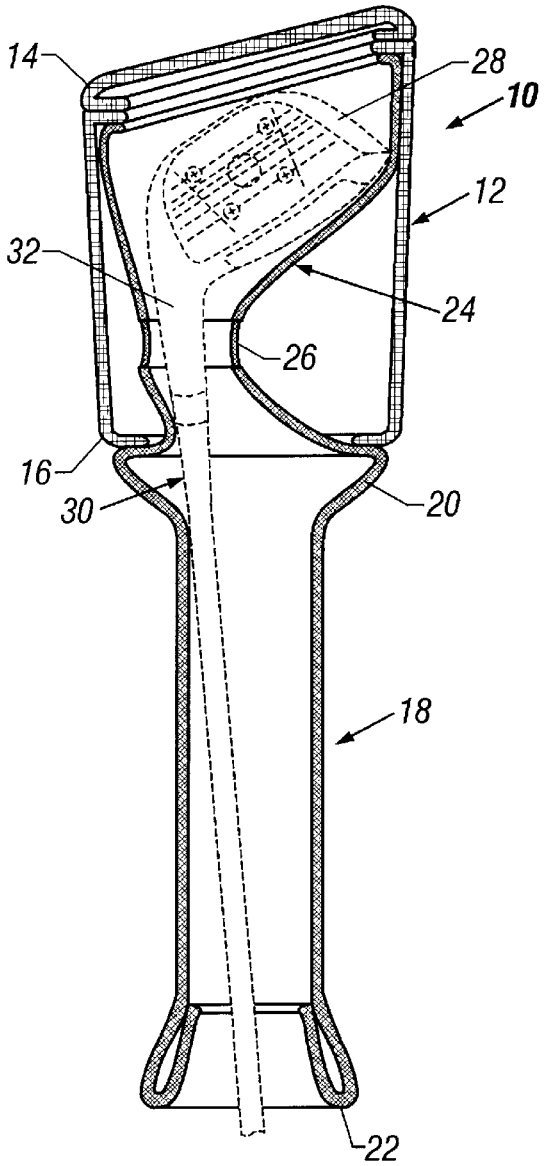
FIG. 3 is a sectional view similar to FIG. 2, showing a club head in the golf club head cover.

As shown in FIGS. 2 and 3, the top end 20 of the shaft protector 18 is sewn to the lower end 16 of the head cover portion 12 and then extends inside of the head cover portion to its upper end 14. A knit sock 24 disposed within the head cover portion 12 includes an elastic section 26 disposed intermediate the upper end 14 and lower end 16 of the head cover portion. In its preferred form, the shaft protector 18 and knit sock 24 inside the head cover portion are integrally formed from a single sock-like member.

As best shown in FIG. 3, the knit sock 24 inside the head cover portion 12 is flexible and forms or shapes to the head 28 of the golf club 30. The elastic section 26 of the knit sock

24 "pinches" around the hossel 32 of the golf club 30, helping to shape the knit sock to the contours of the club head 28. This "sock to the top" design helps to grip the club head in the head cover portion, providing a tighter fit and preventing the club head cover from becoming loose or falling off.

In operation, the golf club head 28 is inserted through the bottom end 22 of the shaft protector and into the head cover portion 12 past the elastic section 26 of the knit sock 24. When the golf club head cover is placed over the golf club in such a manner, the knit sock 24 maintains a relatively tight fit around the club head 28 and prevents the head cover from drooping or falling off of the club head.

The head cover portion 12 and shaft protector 18 of the present invention are of standard construction. The head cover portion 12 can be made from a variety of materials, including leather or a velvet material. The shaft protector 18, as well as the knit sock 24 inside the head cover portion 12 can be knit from a variety of different yarns.

From the foregoing, it can be seen that the present invention overcomes deficiencies in the prior art and includes all of the aforementioned features.

What is claimed is:

1. In a golf club head cover having a hollow head cover portion with an upper end and a lower end, the upper end closed and the lower end open, and an elongated shaft protector with a top end and a bottom end, the top end extending downwardly from near the lower end of the head cover portion, the improvement comprising:

a flexible sock disposed within the hollow head cover portion, extending from near the lower end of the head cover portion to near the upper end of the head cover portion;

wherein the sock is adapted to substantially form to a golf club head in the hollow head cover portion.

2. The golf club head cover of claim 1 wherein the elongated shaft protector and the sock are integrally formed.

3. The golf club head cover of claim 2 wherein the sock includes an elastic section disposed intermediate the upper and lower ends of the head cover section.

4. The golf club head cover of claim 2 wherein the sock is a knit sock.

5. The golf club head cover of claim 1 wherein the elongated shaft protector and the sock are integrally formed.

6. The golf club head cover of claim 5 wherein the sock is a knit sock.

7. The golf club head cover of claim 1 wherein the sock includes an elastic section intermediate the upper and lower ends of the head cover section.

8. The golf club head cover of claim 1 wherein at least a portion of the sock is spaced apart from the head cover portion.

9. The golf club head cover of claim 8 wherein the sock is a knit sock.

10. A golf club head cover comprising:

a hollow head cover portion having an upper end and a lower end, the upper end closed and the lower end open;

an elongated shaft protector with a top end and a bottom end, the top end extending downwardly from near the lower end of the head cover portion; and a flexible sock disposed within the head cover portion, at least a portion of the sock being spaced apart from the head cover portion and adapted to substantially form to a golf club head within the head cover portion.

11. A method for protecting golf club heads of various sizes, the method including the steps of:

providing a hollow head cover portion having an upper end and a lower end, the upper end closed and the lower end open, an elongated shaft protector with a top end and a bottom end, the top end extending downwardly from near the lower end of the head cover portion, and a sock disposed within the hollow head cover portion and extending from near the lower end of the head cover portion to near the upper end of the head cover portion, the sock being adapted to substantially form around the golf club head; and inserting the golf club head through the bottom end of the shaft protector and into the head cover portion so that the sock forms around the golf club head.

12. The method of claim 11 wherein the sock includes an elastic section intermediate the upper and lower ends of the head cover portion and the golf club head is inserted past the elastic section.

13. The golf club head cover of claim 12 wherein the sock is a knit sock.

* * * * *